United States Patent [19]

Haarbye

[11] 3,989,516

[45] Nov. 2, 1976

[54] METHOD OF MAKING SILVER-CADMIUM OXIDE-TIN OXIDE TYPE CONTACT MATERIALS

[75] Inventor: Fredrik O. Haarbye, Indianapolis, Ind.

[73] Assignee: P. R. Mallory & CO., Inc., Indianapolis, Ind.

[22] Filed: Sept. 29, 1975

[21] Appl. No.: 617,340

Related U.S. Application Data

[63] Continuation of Ser. No. 457,069, April 1, 1974, abandoned.

[52] U.S. Cl. ..... 75/173 A; 200/266

[51] Int. Cl.[2] ..... C22C 5/10

[58] Field of Search ..... 75/173 A; 200/266

[56] References Cited

UNITED STATES PATENTS

| | | | |
|---|---|---|---|
| 2,796,346 | 6/1957 | Stumbock | 75/173 A |
| 3,317,991 | 5/1967 | Haarbye | 75/173 A |
| 3,607,244 | 9/1971 | Kabayama | 75/173 A |
| 3,674,446 | 7/1972 | Haarbye et al. | 75/173 A |

*Primary Examiner*—L. Dewayne Rutledge
*Assistant Examiner*—E. L. Weise
*Attorney, Agent, or Firm*—Hoffmann, Meyer & Hanson

[57] ABSTRACT

A method of making silver-cadmium oxide-tin oxide type contact materials by oxidizing three-dimensional particles containing silver, cadmium, and tin and then consolidating the oxidized particles into bodies of the desired configuration. The resultant contact materials have a substantially uniform distribution of relatively coarse cadmium oxide particles, improved arc erosion properties, and little or no depleted or porous grain boundaries.

7 Claims, 4 Drawing Figures

METHOD OF MAKING SILVER-CADMIUM OXIDE-TIN OXIDE TYPE CONTACT MATERIALS

This is a continuation of application Ser. No. 457,069, filed Apr. 1, 1974, now abandoned.

The present invention relates to metallurgy, and more specifically, to a method of making electrical contact materials of the silver-cadmium oxide-tin oxide type.

The quality of an electrical contact material is usually measured by the arc erosion rate of the material when used as a contact for interrupting electrical circuits. The arc erosion rate is the amount of material lost from the contact in a given operation in making and breaking a circuit and thus gives a significant indication of how long the contact material will last. The loss of material is generally due to vaporization of material from heat generated by an electrical arc forming from one contact to another when the two contacts are separated.

Electrical contact materials including silver and cadmium oxide have long been known as excellent materials for certain types of electrical contact applications. These materials, when used in electrical contacts, typically have a high resistance to arc erosion and welding.

Silver-cadmium oxide type materials can be made by three general methods. The first method, the powder metallurgy method, is to prepare powders of silver and cadmium oxide, mix the respective powders together, and then press the mixed powders into the desired configuration. The powder metallurgy method is typically used today when anti-weld characteristics are more important than arc erosion characteristics. The second general method is to prepare a molten alloy of silver and cadmium, cast the alloy, work the alloy into the desired configuration, and then oxidize the cadmium and any other oxidizable constituents to their respective oxides in an oxygen containing atmosphere by the addition of heat. This method is generally known as the post-oxidation method.

The third method, disclosed in U.S. Pat. No. Re. 27,075, is to form small particles by atomization of a molten silver-cadmium alloy, oxidize the cadmium and any other oxidizable constituents in the particles to their respective oxides by heat in an oxygen-containing atmosphere, and then to consolidate the particles by mechanical force into larger bodies. This method is generally known as the preoxidation method.

The particles formed by atomization in the preoxidation method are generally in the shape of flat plates or flakes. Process variables for atomization can be altered so as to produce a very fine powder whose particles are generally of a spherical shape. With either particle shape, at least one dimension of the atomized alloy particle is very small.

Ideally, a silver-cadmium oxide type material should have a uniform distribution of the cadmium oxide particles throughout the silver matrix. Such a distribution of cadmium oxide particles provides for a uniformity of material characteristics and properties when used in an electrical contact.

A uniform distribution of cadmium oxide particles also results in contact materials that have little, if any, depleted cores, depleted matrix grain boundaries or grain boundary porosity near the surface of the material which can harmfully effect the performance characteristics of the material when used as an electrical contact. Such grain boundaries or porosity may result in more rapid wear of the contact face due to lack of cadmium oxide particles or the lack of any contact material whatsoever.

Silver-cadmium oxide type materials, when used in electrical contacts in certain applications, exhibit improved properties such as resistance to arc erosion and anti-weld characteristics when certain additives are included in the contact material. Such additives to silver-cadmium oxide type materials include the metallic elements cobalt (Co), calcium (Ca), tin (Sn), nickel (Ni), zinc (Zn), aluminum (Al), magnesium (Mg), beryllium (Be), sodium (Na), manganese (Mn) and mixtures thereof. Some or most of these additives are converted to their respective oxides in the oxidizing step when used in small amounts.

Tin oxide has been found to be particularly advantageous in contact materials made by the post-oxidation process. Tin is usually added to the alloy melt in amounts of less than about three weight percent of the total contact material. In the post-oxidation method of making this material, elemental tin is included in the silver-cadmium alloy melt and is converted to its oxide along with the cadmium component during the oxidation step. The inclusion of tin into the alloy results in coarse needle-like cadmium oxide particles upon oxidation, a cadmium oxide structure not found in the two component silver-cadmium oxide material made by the post-oxidation method. In a presently unknown fashion, the coarseness of the needle-like structure of the cadmium oxide particles seems to impart enhanced properties, especially a reduced arc erosion rate, to the material when used in an electrical contact.

Although the addition of tin oxide or other additives to silver-cadmium oxide in the post-oxidation process results in improved properties of the material as compared with the two component post-oxidized silver-cadmium oxide, these materials still have significant arc erosion when used in an electrical contact due to the non-uniform distribution of the cadmium oxide particles. One of the major reasons for the non-uniformity of cadmium oxide particle distribution in post-oxidized materials is due to the oxidation process itself. In the oxidation process, oxygen from the external atmosphere diffuses into the silver-cadmium alloy body and initially oxidizes the cadmium located near the surface of the body. Because cadmium oxide is insoluable in silver, cadmium oxide particles precipitate out of the alloy leaving a substantially unalloyed silver phase or matrix. Then, because of the differences in cadmium concentration in the body, some of the cadmium of the unoxidized silver-cadmium alloy located in the interior of the body will migrate toward the substantially unalloyed silver phase. Thus as oxidation proceeds, cadmium is continually migrating toward the surface opposite to the diffusion of oxygen and when this cadmium is oxidized, yields a silver-cadmium oxide body with a relatively high concentration of cadmium oxide particles toward the surface and a relatively low or zero concentration of cadmium oxide particles near the center of the body resulting in what is known as a depleted core. The larger the silver cadmium alloy body is, the more pronounced this concentration difference becomes. Thus the net result is a non-uniformity of cadmium oxide particle distribution.

It is therefore a feature of the present invention to provide a method of making a silver-cadmium oxide-tin oxide type contact materials by a method which produces substantially uniform cadmium oxide particle distribution without depleted cores, depleted grain boundaries or grain boundary porosity. It is another feature of the present invention to provide a method of making a silver-cadmium oxide-tin oxide type contact material with improved resistance to arc erosion. Another feature of the present invention is to provide a method of making silver-cadmium oxide-tin oxide type contact materials by a method which produces materials with better combination of electrical and mechanical properties than by the post-oxidation process. Yet another feature of the present invention is to provide a method of making silver cadmium oxide-tin oxide type contact materials where the cadmium oxide particles exhibit a coarser structure.

The foregoing features and advantages of the present invention will be more clearly understood when considered in conjunction with the accompanying drawings in which.

Figure 1:
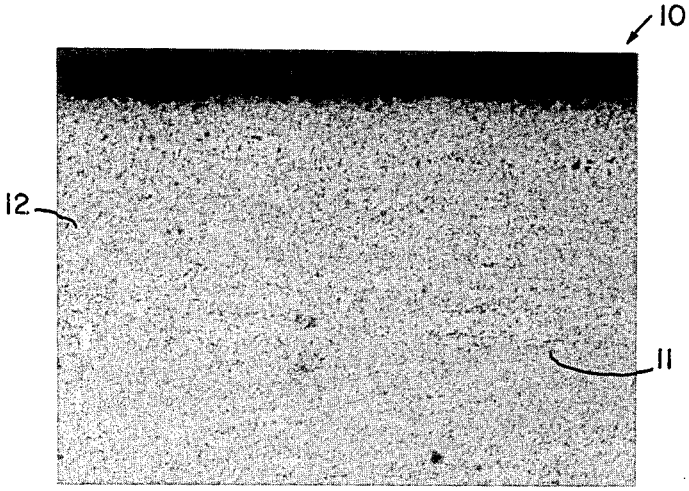
FIG. 1 is photomicrograph of a contact material made by the preoxidation process.

Generally speaking, the invention comprehends a method for making silver-cadmium oxide-tin oxide type contact material. More specifically, the method includes the oxidation of three-dimensional sized particles which include silver, cadmium and tin and then consolidation of the oxidized particles. Such three-dimensional particles allow sufficient volume for growth of cadmium oxide particles and provide a uniform distribution of cadmium oxide particles.

The term three-dimensional particles is used in this disclosure to mean those particles which have an appreciable dimension in all three directions. Examples of three-dimensional particles are spherical particles, cubical particles, cylindrical particles, tetrahedron-shaped particles and the like. The term three-dimensional particles is contrasted to those particles in the shape of plates or flakes which would be characterized as two-dimensional particles or very fine powder which would be characterized as one-dimensional. It is recognized that no particle would be strictly two dimensional, but the nomenclature is used for convenience to distinguish between the general types of particles.

The method of the invention comprises the steps of making an alloy or composition containing silver, cadmium and tin, forming three-dimensional particles of the alloy or composition, oxidizing the particles by the application of heat in an oxygen containing atmosphere, and consolidating the particles into a body which can be adapted for use as an electrical contact.

The three-dimensional particles may be formed by various methods including separating lengths of wire into desired shorter lengths by, for example, chopping or cutting and destruction of large bodies into smaller bodies by methods such as machining, filing, cutting and sawing. The preferred particle shapes are chopped wire, commonly known as slugs, because of ease of forming these particles.

The three-dimensional particles should be small enough to allow substantially uniform oxidation to take place without the formation of depleted cores. For example, a particle containing about 10% cadmium by weight should not have a point within its volume more than about 0.070 inches from an exterior surface. This maximum distance is sometimes referred to as the oxidation path. Thus, in the case of a chopped wire particle, the maximum diameter of the wire should be about 0.140 inches to insure adequate oxidation and uniformity of cadmium oxide concentration. For a particle containing about 15% wt. % cadmium, the oxidation path is about 0.050 inches and therefore at least one dimension should not be more than about 0.100 inches. The other two dimensions should be sufficiently small to allow easy consolidation of the particles. In the case of chopped wire, the preferred length is less than one inch. The above approximate limitations on particle size are only suggested to achieve desirable results and may possibly be exceeded under certain processing conditions or with certain material compositions.

Contact materials containing silver, cadmium oxide and tin oxide made by the method of this invention exhibit a substantially uniform distribution of cadmium oxide particles throughout the material and thus more uniform electrical characteristics. There is also less evidence of depleted grain boundaries and grain boundary porosity with contact materials made by the method of this invention. Cadmium oxide particle size is often coarser when the material is producted by the method of this invention as compound materials made by a preoxidation method because there is sufficient particle volume for the needle-like cadmium oxide structure to be formed. Such characteristics of the material result in low arc erosion rates, high hardness and good electrical conductivity when the material is used in an electrical contact. Compositions of silver-cadmium oxide-tin oxide that may be made by the method of this invention are from about 1.0 wt.% cadmium oxide to about 30 wt.% cadmium oxide, an effective amount to about 10 wt.% tin oxide, and the balance substantially silver. Beyond about 30 wt.% cadmium oxide, the electrical conductivity of the contact material is not sufficient for the material to function effectively as an electrical contact and it is difficult to process the material by wrought metal processing techniques.

The preferred composition of the material made by the method of this invention is about 1 wt.% to about 25 wt.% cadmium oxide, an effective amount to about 10 wt.% tin oxide and the balance substantially silver. The most preferred composition is about 5 wt.% to about 20 wt.% cadmium oxide, about 0.5 wt.% to about 3.0 wt.% tin oxide and the balance substantially silver.

The method of the invention is advantageous because tin is included in the alloy before oxidation. When the three-dimensional particles are oxidized, the tin component helps to produce larger cadmium oxide particles which are able to be formed due to the sufficient volume of the particles and the larger cadmium oxide particles are substantially uniformly dispersed throughout the contact material.

Referring now to the drawings, FIG. 1 is 300× magnification photomicrograph of transverse cross section of a silver-cadmium oxide-tin oxide contact material made from the consolidation of two-dimensional oxidized particles. The material has a composition of about 88.2 wt.% Ag, about 9.8 wt.% CdO, and about 2.0 wt.% SnO. The material 10 has a less than uniform cadmium oxide particle distribution 11 throughout the silver matrix 12 and the cadmium oxide particle size is relatively small.

Figure 2:
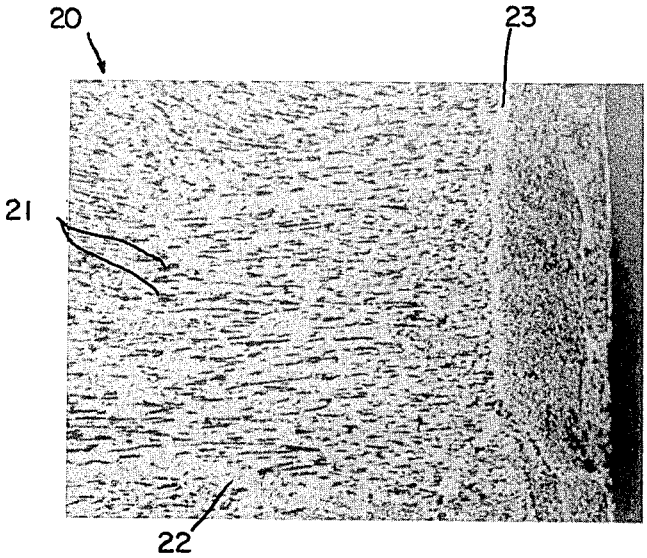
FIGS. 2 and 3 are photomicrographs of a contact material made by the post-oxidation process.
Figure 3:
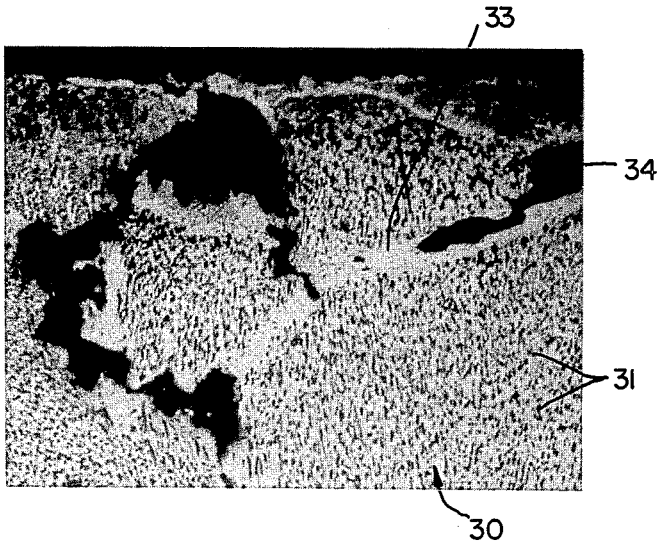

FIG. 2 and FIG. 3 are 300× magnification photomicrographs of a silver-cadmium oxide-tin oxide contact materials made from the post-oxidized body produced from cast billets of Ag, Cd and Sn. The materials have a composition of about 88.2 wt.% Ag, about 9.8 wt.% CdO, and about 2.0 wt.% SnO. The contact material 20 of FIG. 2 has non-uniform distribution of large needle-shaped cadmium oxide particles 21 throughout a silver matrix 22. Near the surface of the contact material 20, there are depleted grain boundaries 23 which contain no cadmium oxide particles.

The contact material 30 of FIG. 3 illustrates the needle-shaped cadmium oxide particles 31 but also depleted grain boundaries 33 near the surface of the material which have porous or void areas 34. Such void areas 34 produce more rapid wear when the material is used in an electrical contact and thereby reduces the useful life of the contact.

Figure 4:
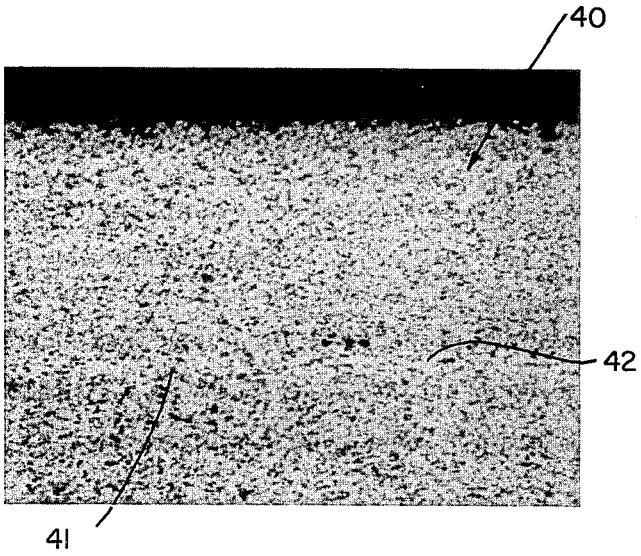
FIG. 4 is a photomicrograph of a contact material made according to this invention.

FIG. 4 is a 300× magnification photomicrograph of a silver-cadmium oxide-tin oxide contact material made from the consolidation of oxidized wire slugs according to this invention. The material has a composition of about 88.2 wt.% Ag, about 9.8 wt.% CdO and about 2.0 wt.% SnO. The material 40 has a substantially uniform distribution of cadmium oxide particles 41 throughout the silver matrix 42. The cadmium oxide particles 41 are somewhat larger than those of the two-dimensional particle material of FIG. 2. There is little, if any, evidence of porosity of depleted grain boundaries near the surface of the contact material.

From a comparison of the contact materials as shown in the FIGS. 1–4, as made by the several methods with materials containing tin oxide, it is evident that the material made by the method of this invention has a better combination of the properties of good silver-cadmium oxide type contact materials; uniformity of cadmium oxide particle distribution, coarser cadmium oxide particles, and lack of depleted matrix grain boundaries or grain boundary porosity.

A preferred method according to this invention for making electrical contact materials and the properties of the resultant materials as compared to contact materials made by standard methods can be more clearly shown by the following example and the accompanying test data. It should be understood that the example is given for the purposes of illustration only and the example does not limit the invention as has heretofore been described.

EXAMPLE

Three types of AgCdO-SnO contact material are made, one type according to this invention, one type by consolidation of oxidized two-dimensional particles or flake, and one type made according to the post-oxidation process. These materials are fabricated into the form of electrical contacts and are tested to compare their respective physical and electrical properties.

To make the three types of contact materials, two identical melts, A and B, are prepared by combining about 88.7 parts Ag with about 9.6 parts Cd and about 1.7 parts Sn. Melt A is poured to make two castings C and D of the composition of about 89.5 wt.% Ag, about 8.7 wt.% Cd and about 1.8 wt.% Sn. The final casting composition changes of from the initial composition due to vaporization losses, especially in the cadmium component.

Casting C is then extruded and worked into wire and cut into small, cylindrical, wire pieces or slugs.

Melt B is poured into a metallic funnel with a graphite bottom with several holes in it. The liquid melt, after going through the holes, becomes a small stream and is then subjected to an air jet which breaks the liquid melt stream into small particles in the general shape of flakes. The flakes fall into a cooling bath where they solidify. The flakes have the composition of about 89.5 wt.% Ag, about 8.7 wt.% Cd and 1.8 wt.% Sn.

The flakes of melt B and the wire slugs of casting C are then oxidized at about 815° C in an oxygen rich atmosphere. The final compositions of the particles and slugs are about 88.2 wt.% Ag, about 9.8 wt.% CdO and about 2.0 wt.% SnO.

The flakes of melt B and wire slugs of casting C are then compacted into billets by pressure of about 200 tons and are then separately extruded into strips. A fine silver backing is attached by rolling to the strips from the billets and the strip from casting D. All three strips are then reduced in thickness by cold rolling to a thickness of about ⅛ inch. The strip from casting D is then oxidized at about 800° C. All three oxidized strips are then annealed at about 800° C for about one hour prior to testing.

The three types of contact materials are compared to each other by measuring their electrical conductivity and hardness. The results are set forth in TABLE I.

TABLE I

| | Material Composition | | | Method of | Elec. | Hardness |
|---|---|---|---|---|---|---|
| | Ag | CdO | SnO | Oxidation | Cond. (%IACS) | ($R_F$) |
| B | 88.2 | 9.8 | 2.0 | pre (flake) | 82 | 84 |
| C | 88.2 | 9.8 | 2.0 | pre (wire slugs) | 84 | 78 |
| D | 88.2 | 9.8 | 2.0 | post | 72 | 56 |

Material C, made by the method of this invention, and material B have high test values of electrical conductivity and hardness and therefore a better combination of these values than does material D made from the post-oxidized strip. These properties are desirable and should be maximized in an electrical contact material since a high electrical conductivity results in greater current carrying capability and increased hardness provides improved anti-weld properties.

Three electrical contacts made from each one of the strips are then subjected to high current arc erosion testing at about 210 amperes current for approximately 100,000 cycles. The results of the test are summarized in Table II.

TABLE II

HIGH CURRENT RELAY TEST RESULTS
220 VAC — 210 amps — 50% P.F. — 75 ops/min.
3 contacts tested/material — average given

| Material | Method of Oxidation | Weight loss in Milligrams Moving | Stationary | Total | mg/10³ operations |
|---|---|---|---|---|---|
| B | pre (flake) | 262.0 | 220.3 | 482.3 | 4.82 |
| C | pre (wire slugs) | 190.7 | 187.3 | 378.0 | 3.78 |
| D | post | 207.6 | 215.2 | 422.8 | 4.23 |

Thus the contact material formed by the method of this invention has the best overall arc erosion rate of the materials tested and compared to material of the same composition made from two-dimensional particles or flake, the arc erosion rate for the material made by this invention is approximately 21 percent less. The arc erosion rate for the material made by the method of this invention is less (about 10 percent) than that of post-oxidized material of the same composition.

Overall, the material made by the method of this invention has the best combination of the tested properties of electrical conductivity, hardness, and arc erosion rate as compared to materials of the same composition made by standard methods.

Thus the invention as has been herein described comprehends a method of making silver-cadmium oxide-tin oxide type contact materials that result in materials that are characterized by substantially uniform distribution of cadmium oxide particles, relatively coarse cadmium oxide particles, lack of depleted matrix grain boundaries and grain boundary porosity, and excellent physical properties such as electrical conductivity, hardness and arc erosion rate.

It should be understood that the method of this invention comprehends the presence of small amounts of other additive metals with the Ag, Cd and Sn components in the starting material. Such additive metals would include cobalt (Co), calcium (Ca), nickel (Ni), aluminum (Al), magnesium (Mg), beryllium, (Be), iron (Fe), manganese (Mn), cerium (Ce), lanthanum (La), neodymium, (Nd), strontium (Sr), yttrium (Y), indium (In), antimony (Sb), scandium (Sc), gallium (Ga), thallium (Tl), lithium (Li), bismuth (Bi), zirconium (Zr), niobium (Nb), and mixtures thereof in amounts that would not harmfully affect the characteristics and properties of the contact material. Typically, these additive metals may be included in the Ag-CdO-SnO material to improve certain properties thereof from an effective amount to about the following wt. percents;

| | | | | | |
|---|---|---|---|---|---|
| Co | 0.5 | Mn | 1.0 | Sb | 1.0 |
| Ca | 0.2 | Ce | 0.2 | Sc | 1.5 |
| Ni | 0.5 | La | 0.2 | Ga | 0.5 |
| Al | 1.0 | Nd | 0.2 | Tl | 2.0 |

-continued

| | | | | | |
|---|---|---|---|---|---|
| Mg | 0.2 | Sr | 0.2 | Li | 1.0 |
| Be | 0.2 | Y | 0.2 | Bi | 1.0 |
| Fe | 2.0 | In | 1.0 | Zr | 1.0 |
| | | | | Nb | 1.0 |

The term cadmium oxide particle, as used in reference to this invention, includes particles composed of cadmium oxide only and particles composed of cadmium oxide and small but effective amounts of tin oxide and possibly oxides of other metal additives.

While the present invention has been described with reference to particular embodiments thereof, it will be understood that numerous modifications may be made by those skilled in the art without actually departing from the spirit and scope of the invention as defined in the appended claims.

I claim:

1. A method of making silver-cadmium oxide-tin oxide type electrical contact materials comprising the steps of providing wire containing Ag-Cd-Sn, reducing the wire into a plurality of three-dimensional shapes, subjecting the three-dimensional shapes containing Ag-Cd-Sn to an oxygen containing atmosphere and heat to oxidize oxidizable constituents, consolidating the oxidized three-dimensional shapes, forming the consolidated three-dimensional shapes into the desired shape.

2. The method of claim 1 wherein the three-dimensional shapes containing Ag-Cd-Sn are wire slugs.

3. The method of claim 2 wherein the forming step includes the step of extruding the consolidated three-dimensional shapes.

4. The method of claim 3, wherein the extruded shape is worked to the extent necessary to obtain the desired final size.

5. The method of claim 3, wherein the compacted wire slugs are extruded into either strip or wire.

6. The method of claim 1, wherein the three-dimensional shapes prior to the step of oxidation contain about 5 wt.% to about 25 wt.% Cd, about 0.01 wt.% to about 3 wt.% Sn, and the remainder Ag.

7. The method of claim 2 wherein the wire slugs have a length of about 0.5 inch or less and a diameter of about 0.14 inch or less.

* * * * *